US005420806A

United States Patent [19]

Shou et al.

[11] Patent Number: 5,420,806

[45] Date of Patent: * May 30, 1995

[54] MULTIPLICATION CIRCUIT FOR MULTIPLYING ANALOG SIGNALS BY DIGITAL SIGNALS

[75] Inventors: Guoliang Shou; Weikang Yang; Sunao Takatori; Makoto Yamamoto, all of Tokyo, Japan

[73] Assignee: Yozan Inc., Tokyo, Japan

[ * ] Notice: The portion of the term of this patent subsequent to Nov. 1, 2011 has been disclaimed.

[21] Appl. No.: 181,118

[22] Filed: Jan. 13, 1994

[30] Foreign Application Priority Data

Jan. 13, 1993 [JP] Japan ..... 5-020676

[51] Int. Cl.[6] ..... G06J 1/00

[52] U.S. Cl. ..... 364/606

[58] Field of Search ..... 364/606, 602

[56] References Cited

U.S. PATENT DOCUMENTS 4,422,155 12/1983 Amir et al. ..... 364/606
4,470,126 9/1984 Hague ..... 364/606
4,475,170 10/1984 Hague ..... 364/606

OTHER PUBLICATIONS

IWAI, "The Beginning of Logical Circuit", Tokyo Denki Daigaku Shuppankyoku, 1980, pp. 144–146.
Electrical Engineering Handbook, pp. 1861–1865, 1993.
Miyazaki, "The Analog Usage Handbook", CQ Suppan Kabushikigaisha, 1992, pp. 139–140.

*Primary Examiner*—Tan V. Mai
*Attorney, Agent, or Firm*—Cushman, Darby & Cushman

[57] ABSTRACT

A multiplication circuit for controlling an analog input voltage by the use of a switching signal created by a digital voltage so as to either generate an analog output or to cut-off the output. A digital input signal having a plural number of bits with given weights are introduced by use of capacitive coupling, and the resulting total becomes the multiplication result.

4 Claims, 1 Drawing Sheet

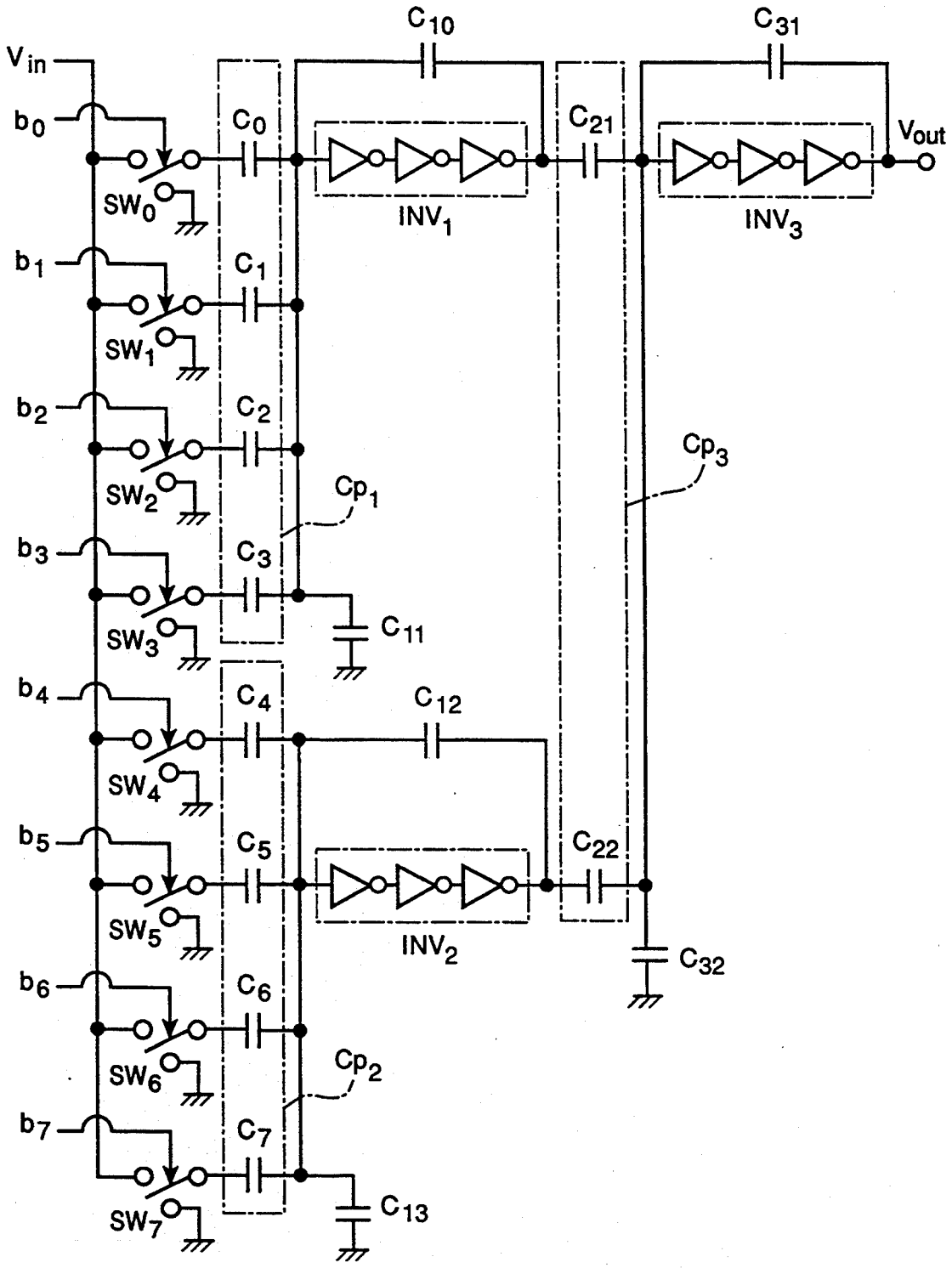
Vin
b0
b1
b2
b3
b4
b5
b6
b7
SW0
SW1
SW2
SW3
SW4
SW5
SW6
SW7
C0
C1
C2
C3
C4
C5
C6
C7
C10
C11
C12
C13
C21
C22
C31
C32
INV1
INV2
INV3
Cp1
Cp2
Cp3
Vout

MULTIPLICATION CIRCUIT FOR MULTIPLYING ANALOG SIGNALS BY DIGITAL SIGNALS

BACKGROUND OF THE INVENTION

1. Field of the Invention

The present invention relates to a multiplication circuit for multiplying an analog signal by digital signals.

2. Description of the Art

In recent years, there has been controversy over the limitations of digital computers due to the exponential increase in the amount of money invested in equipment relating to minute processing technology. Thus, analog computers are now receiving greater attention. On the other hand, conventional digital storage technology should be used and thus, both digital processing and analog processing which work together are necessary. However, conventionally, a circuit which directly operates on analog and digital data without using A/D and D/A converters has not been previously known.

SUMMARY OF THE INVENTION

The present invention is invented so as to solve the problems mentioned above. The multiplication circuit, according to the present invention, is capable of directly multiplying an anolog signal and digital signals without the need for A/D or D/A converting.

A multiplication circuit according to the present invention controls an analog input voltage by the use of a switching signal created by a digital voltage so as to either generate an analog output or to cut-off the output. A digital input signal of a plural number of bits with given weights are introduced by means of capacitive coupling, and the total becomes the multiplication result. Furthermore, the invention operates by classifying the bits of digital data, then weighing them in the group and in a group unit, and then expansion of the range of values of the capacitance is controlled.

BRIEF DESCRIPTION OF THE DRAWINGS

FIG. 1 is a circuit showing an embodiment according to the present invention.

DETAILED DESCRIPTION OF THE PRESENTLY PREFERRED EXEMPLARY EMBODIMENTS

Hereinafter, an embodiment of a multiplication circuit according to the present invention is described with reference to the attached drawings.

In FIG. 1, a pultiplication circuit has switching means $SW_0$ to $SW_7$, wherein an anolog data $V_{in}$ is input. The switching means are controlled for switching by each bit $b_0$ to $b_7$ of the digital signal. The switching means are classified into 2 groups: the first group being $G_1$ and the second group being $G_2$. The first group $G_1$ has switching means $SW_0$ to $SW_3$, and the second group $G_2$ has switching means $SW_4$ to $SW_7$. Each group is connected by capacitive couplings $CP_1$ and $CP_2$, respectively.

Capacitive coupling $CP_1$ consists of capacitances $C_0$ to $C_3$. Capacitive coupling $CP_2$ consists of capacitances $C_4$ to $C_7$. Capacitances $C_0$ to $C_3$ have capacities in proportion to weights $b_0$ to $b_3$, respectively. Capacitances $C_4$ to $C_7$ have capacities in proportion to weights $b_4$ to $b_7$, respectively. Furthermore, $CP_1$ and $CP_2$ are connected to a ground potential through capacitances $C_{11}$ and $C_{13}$.

The outputs of $CP_1$ and $CP_2$ are input to inverters $INV_1$ and $INV_2$, respectively, and the outputs of inverter $INV_1$ and $INV_2$ are connected through capacitive coupling $CP_3$. The output of $CP_3$ is output as analog data $V_{out}$ through an inverter $INV_3$, and $CP_3$ is connected to a ground potential through capacitance $C_{32}$.

The three inverters $INV_1$ to $INV_3$ are serially connected, and accurate outputs of each inverter is maintained. In each inverter, its output is fed back to the input through $C_{10}$, $C_{12}$ and $C_{31}$. The capacitiies are set as follows.

$$C_{10}-C_{11}=C_0+C_1+C_2+C_3 \quad (1)$$

$$C_{12}-C_{13}=C_4+C_5+C_6+C_7 \quad (2)$$

$$C_{31}-C_{32}=C_{21}+C_{22} \quad (3)$$

If the gain of $INV_1$ to $INV_3$ is defined as G, the voltages impressed on $C_0$ to $C_7$ are defined as $V_0$ to $V_7$, the input voltages of $INV_1$ and $INV_2$ are defined as $V_{11}$, and $V_{12}$, respectively, the output voltages are defined as $V_{21}$ and $V_{22}$, respectively, and the input voltage of $INV_3$ is defined as $V_{31}$, then formulas (4), (5) can be obtained.

$$\sum_{i=1}^{3} C_i(V_i - V_{11}) + C_{10}(V_{11} - V_{21}) + C_{11}V_{11} = 0 \quad (4)$$

$$\sum_{i=4}^{7} C_i(V_i - V_{12}) + C_{12}(V_{12} - V_{22}) + C_{13}V_{12} = 0 \quad (5)$$

Under certain conditions formulas (6) and (7) can be established.

$$C_{21}V_{21}+C_{22}V_{22}+C_{31}(V_{31}-V_{out})+C_{32}V_{31}=0 \quad (6)$$

$$V_{21}=GV_{11};\ V_{22}=GV_{12};\ \text{and}\ V_{out}=GV_{31} \quad (7)$$

Then formulas (8) and (9) can be defined as follows.

$$V_{21} = \sum_{i=1}^{3} C_iV_i/C_{10} \quad (8)$$

$$V_{22} = \sum_{i=4}^{7} C_iV_i/C_{12} \quad (9)$$

Formula (10) is then obtained.

$$V_{out}=(C_{21}V_{21}+C_{22}V_{22}) \quad (10)$$

When $SW_1$ is connected with $V_{in}$ or the ground potential corresponding to $b_0$ to $b_7$, and $V_i$ is equal to $V_{in}$ or 0, and following formulas are obtained.

$$C_1=2^i\times Cu\ (i=0\ \text{to}\ 3) \quad (11)$$

$$C_i=2^{i-4}\times Cu\ (i=4\ \text{to}\ 7) \quad (12)$$

$$C_{11}=C_{13}=C_{32}=Cu \quad (13)$$

wherein Cu is an unit capacity $$C_{22}=2^4\times C_{21} \quad (14)$$

$$C_{31}=2^4\times Cu \quad (15)$$

Therefore, the final output becomes a multiplication result of an anolog signal and digital signals.

Formula (16) can then be defined as follows.

$$V_{out} = \sum_{i=0}^{7} 2^i b_i V_{in}/2^8 \quad (16)$$

When formula (17) is true, then formula (18) is obtained.

$$C_{31} = 2^3 \times Cu \quad (17)$$

$$V_{out} = \sum_{i=0}^{7} 2^i b_i V_{in}/2^7 \quad (18)$$

A level of formula (18) is twice that of formula (16). By this type of level controlling, a moving are can be selected.

As shown by formula 12, bits $b_0$ to $b_3$ and $b_4$ to $b_7$ of digital data are in different groups and a weight is given to each of the bits. The order of $2^3$ is sufficiently in the range of capacticances $C_0$ to $C_7$, because the multiplication result of higher groups are given a weight corresponding to the group.

As mentioned above, a multiplication circuit according to the present invention controls an analog voltage by the use of a switching signal of a digital voltage so as to either generate an anolog output or to cut off the output. A digital input signal of a plural number of bits are given weights by means of capacitive coupling, and the total becomes a multiplication result. Furthermore, the invention operates by classifying the bits of digital data, then weighing them in the group and in a group unit, and then expansion of the range of values of the capacitance is controlled.

What is claimed is:

1. A multiplication circuit for multiplying an analog signal and a digital signal having bits comprising:

a plurality of first capacitances arranged so as to correspond to groups in which said bits of said digital signal are classified, each said first capacitance having a capacitance value corresponding to a bit weight to be assigned to said bits of each said corresponding group;

a plurality of second capacitances arranged so as to correspond to each bit that is included in each of said corresponding groups, each said second capacitance having a capacitance values corresponding to a bit weight to be assigned to each said bit; and a plurality of switching means for connecting said analog signal to each said first capacitance.

2. A multiplication circuit according to claim 1, wherein said digital data includes 8 bits.

3. A multiplication circuit according to claim 1, wherein each said group includes 4 bits.

4. A multiplication circuit according to claim 1, further comprising an amplifier having a feed back system, and wherein an output of said multiplication circuit is voltage compensated by said amplifier.

* * * * *